United States Patent [19]

Hanson

[11] 4,106,226

[45] Aug. 15, 1978

[54] BIDIRECTIONAL ROTARY EXCAVATOR

[76] Inventor: Raymond A. Hanson, c/o R.A. Hanson Co., P.O. Box 7400, Spokane, Wash. 99207

[21] Appl. No.: 769,932

[22] Filed: Feb. 18, 1977

[51] Int. Cl.[2] ..... E02F 3/24

[52] U.S. Cl. ..... 37/190

[58] Field of Search ..... 198/307; 214/10; 37/91, 37/94–97, 191 R, 191 A, 192 R, 192 A, 108 R, 110, 99, 100, 83–90

[56] References Cited

U.S. PATENT DOCUMENTS

| | | | |
|---|---|---|---|
| 114,395 | 5/1871 | Boas | 37/94 |
| 199,106 | 1/1878 | Randolph | 37/94 |
| 1,911,615 | 5/1933 | George | 37/86 UX |
| 3,690,023 | 9/1972 | Peterson | 37/97 X |
| 3,916,544 | 11/1975 | Swisher, Jr. et al. | 37/110 |

FOREIGN PATENT DOCUMENTS

| | | | |
|---|---|---|---|
| 326,299 | 3/1972 | U.S.S.R. | 37/99 |

*Primary Examiner*—Clifford D. Crowder
*Attorney, Agent, or Firm*—Wells, St. John & Roberts

[57] ABSTRACT

A bidirectional excavator capable of excavating a predetermined swath of earth while moving in a forward or rearward longitudinal direction. The excavator includes a rotatable excavator wheel that operates to disengage and move loosened earth to a centrally located transverse conveyor belt. The belt carries the loosened material to one side of the excavator. Retractable crumbing blades are located on both forward and rearward sides of the excavator wheel. Each is selectively operable to be lowered to an operative position adjacent to the wheel with regard to the selected direction of movement for the machine. The lowered crumbing blade serves to gather and maintain material sloughed from the wheel against the wheel so it may be eventually carried to the discharge conveyor. When it is desired to move the excavator in an opposite direction, the operative crumbing blade is retracted and the previously inoperative plate is extended to its operative position. Design of the excavator wheel is such that it may be rotated in the same direction regardless of directional movement of the machine. Thus, the machine is capable of moving along an elongated path in a forward direction taking a prescribed swath of earth as it goes, and subsequently moving in an opposite direction in order to take the next successive swath.

1 Claim, 7 Drawing Figures

BIDIRECTIONAL ROTARY EXCAVATOR

BACKGROUND OF THE INVENTION

The present invention is related basically to the field of earth excavators and more particularly to that area of the field concerned with such excavators that utilize a bucket wheel arrangement to dislodge and remove earth to a specified grade and, using in conjunction therewith, one or more crumbing blades.

Excavating machinery, particularly such machinery utilizing a bucket wheel form of earth removing means, are typically unidirectional since they are capable of operating only when moving in a forward direction. Thus, at the end of each elongated swath taken, the machine must be moved back to its original starting place before beginning the next successive swath. It has become desirable to obtain some form of excavating machine including the advantages inherent in a bucket wheel type excavator that is also capable of operation both in forward and rearward longitudinal directions. This desirable feature is provided by the present invention in a pair of retractable crumbing blades. The blades are located on opposite sides of the digging or excavating wheel and are independently operable to extend to operative positions. Each blade includes a scraping edge that is located in a plane substantially tangential to the bottom of the cutter periphery (when operative). Each is also movable to a retracted position clear of the wheel and ground surface being operated upon. In operation, either crumbing blade functions to scrape along the ground directly behind the digging wheel to catch and refeed loose material to the buckets of the digging wheel. The operative blade also forms a relatively smooth finished surface behind the machine. Functionally, the crumbing blade acts similarly to the blade of a surfacing machine or grader. Since two of the retractable blade assemblies are provided one on each side of the digging wheel, it is possible that a leveling and loose feeding function may be performed regardless of whether the machine is moving in a forward or rearward direction.

U.S. Pat. No. 2,782,535 to R. Fuller et al granted Feb. 26, 1957 discloses a ditching machine that makes use of a fixed form of crumbing blade assembly. The blade assembly set forth in this patent is exemplary of the general form of such blades as commonly known in the industry. The blade is fixed to a supportive framework and follows behind a rotatable digging wheel. The purpose for the blade is to catch loose material and refeed it to the digging wheel while forming a relatively smooth, accurate surface behind the machine. A similar, stationary form of crumbing blade is illustrated in U.S. Pat. No. 2,088,369 granted to B. H. Flynn on July 27, 1937. Again, the crumbing blade in this machine is fixed to a supportive framework and operates in response to movement of the machine and operation of an associated digging wheel in a prescribed forward direction. Several different forms of the stationary blade disclosed in the Flynn patent are utilized to complement the shape of the cutting wheel.

SUMMARY OF THE INVENTION

A bidirectional excavating machine is described that includes a rigid framework and means on the framework for carrying it along the ground surface in a forward or a rearward direction. An excavator wheel is mounted to the framework for rotation about an axis substantially transverse to the forward or rearward path of travel. A drive means is provided for rotating the excavator wheel such that it will engage and loosen surface material along the path to a prescribed grade. A conveying means receives the material excavated by the wheel and delivers it to one side of the machine. A first retractable crumbing blade means is located on the framework forwardly adjacent to the excavator wheel. It is adapted to be lowered to an operative position when the machine is operating in a rearward direction. It may also be raised to an inoperative position when the machine is operating in a forward direction. A second retractable crumbing blade means is also provided on the framework. It is located rearwardly adjacent to the excavator wheel and is adapted to be lowered to an operative position when the machine is operating in a forward direction. It may be raised to an inoperative position when the machine is operating in a rearward direction. Lift means is provided for selectively moving the first and second crumbing blade means between the operative and inoperative positions.

A primary object of the present invention is to provide a bidirectional excavating machine that includes a pair of retractable crumbing blades which will function equally efficiently whether the machine is moving forward or backward.

An additional object is to provide such a machine that is sturdy in construction and capable of operating in relatively rough terrain.

An additional object is to provide such a machine wherein the crumbing blades operate in close relation to the excavating wheel and will therefore not allow a large buildup of material to be moved ahead of the blades while the machine is in operation. Therefore, power requirements to operate the machine are held at a minimum.

A still further object is to provide such an excavating machine wherein the crumbing blades are foldable to inoperative positions sufficiently clear of the ground and excavating wheel to allow passage of relatively large particulate matter such as rocks to the excavating wheel.

Another object is to provide such an excavating machine wherein the crumbing blades thereof may be selectively adjustable to define a selected grade other than that roughly defined by the excavating wheel.

These and still further objects and advantages will become apparent upon reading the following detailed description which, taken with the accompanying drawings, describe a preferred form of the invention. It is noted however that the description is given merely by way of example to set forth a preferred embodiment. It is not intended that the description be taken as restrictive upon the scope of my invention. Only the claims found at the end of this specification are to be taken as definitions in which the scope of my invention is clearly set out.

DETAILED DESCRIPTION OF A PREFERRED EMBODIMENT

Figure 1:
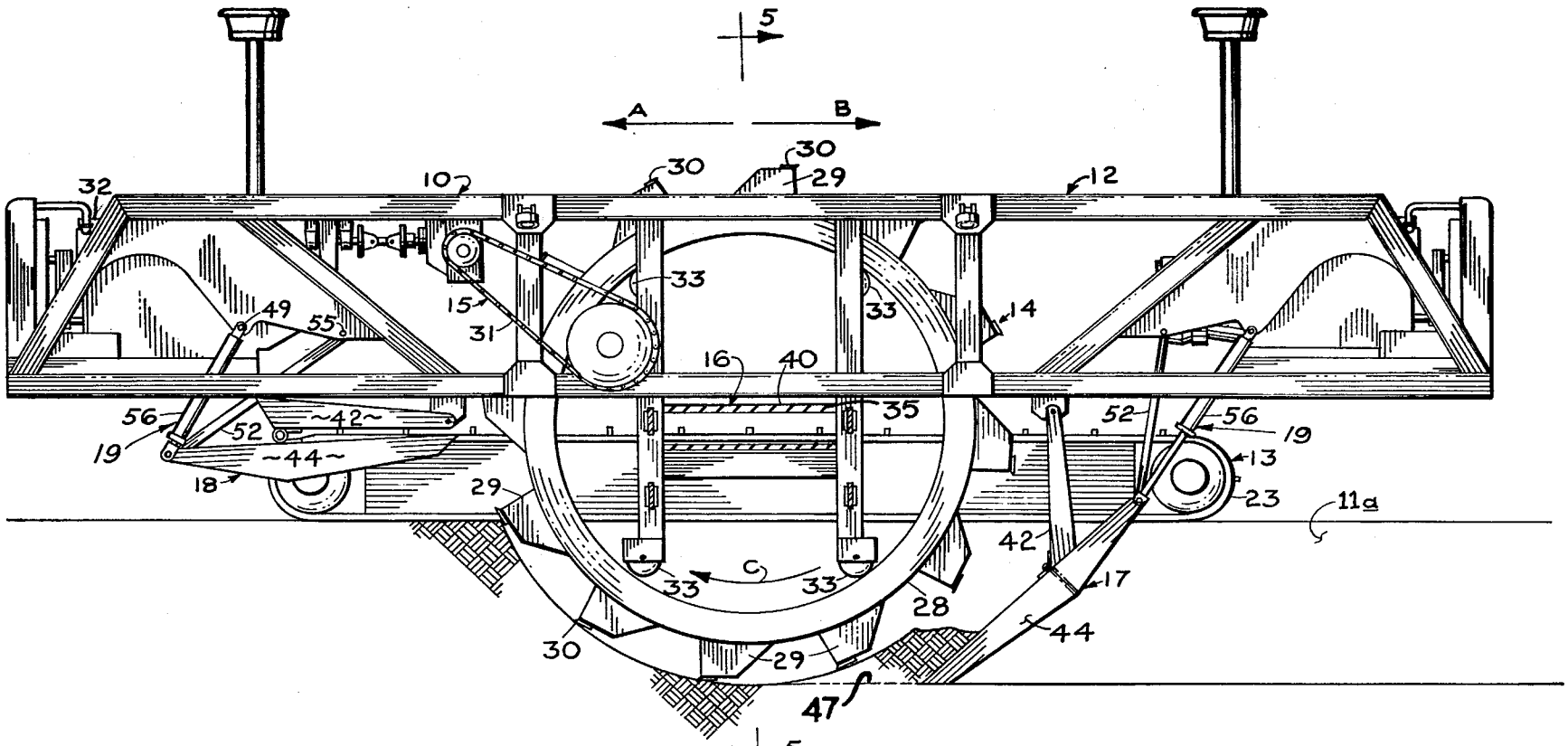
FIG. 1 is a longitudinal sectioned end elevation view of the present machine.

An excavator is indicated by the reference numeral 10 in the accompanying drawings. Its purpose is to remove surface material (earth, minerals, etc.) to a prescribed grade level. The excavator 10 is capable of operating in a forward direction as indicated by the arrow A in FIGS. 1 and 6, or a rearward direction as indicated by the arrow B in FIGS. 1 and 7. The machine is intended to operate against longitudinal upright earthen face 11 (FIG. 2) while moving in either the directions A or B as shown. The material excavated by machine 10 is delivered to one side of the machine for subsequent processing. Although the machine 10 is shown in a prescribed manner for a particular use, it is to be understood that the components thereof may be altered such that the machine may be utilized for other purposes, e.g. a canal or ditch excavator, and that such similar apparatus comes within the scope of the claims found at the end of the specification.

The present machine 10 is shown including a supporting framework 12 of rigid construction. The framework 12 is movably supported by a transport means 13. Means 13 is capable of holding the frame in a prescribed angular orientation in relation to the ground surface being excavated and is further capable of moving the machine along a longitudinal path in either direction as indicated by arrows A and B.

Figure 6:
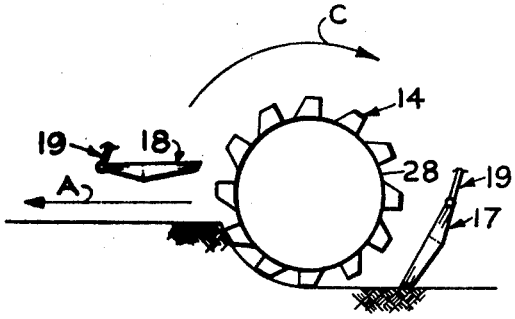
FIG. 6 is a diagrammatic view illustrating operation of the present machine while moving in one direction.
Figure 7:
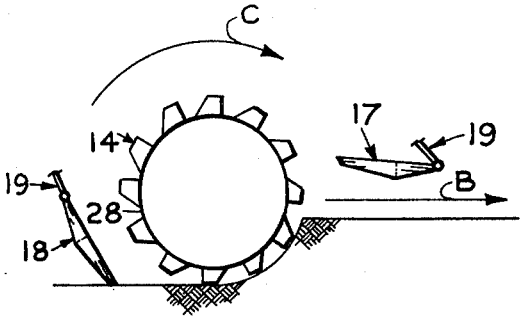
FIG. 7 is a diagrammatic view similar to FIG. 6 only showing the machine operating in an opposite direction.

An excavating wheel 14 is rotatably carried on the frame 12 and is operated to rotate by a drive means 15. Wheel 14 functions to engage and loosen material along each operative swath taken by the machine. Wheel 14 is rotated by means 15 (FIG. 1) about an axis transverse to the paths of movement in the forward or rearward direction. The wheel removes material in a specific amount at a selected depth, leaving a vertical face 11*a* and removing the previous face 11. The drive means 15 is operable to rotate the wheel 14 in a clockwise direction as seen in FIG. 1. The wheel will function to loosen material while moving in either longitudinal direction. The only difference is the manner in which the material is lifted and the direction of cut for the earth engaging elements thereon. FIGS. 6 and 7 diagrammatically illustrate the difference in the cutting operation performed by the wheel when moved first in a forward direction in FIG. 6 and, in FIG. 7, a rearward direction.

The excavator wheel 14 is utilized both to loosen material from the earth's surface and also to lift the loosened material onto a transverse conveyor means 16. Note in FIGS. 1 and 5 that the conveyor means 16 is situated within the confines of wheel 14. Conveyor means 16 is so situated to receive material from wheel 14 as it is rotated about the transverse axis. Material is lifted upwardly by buckets on the wheel and is dumped on the working flight of conveyor means 16. Wheel means 14 is not capable of immediately delivering excavated material to the working flight of conveyor means 16. Material will spill over the conveyor sides or be dropped on either side of the conveyor onto the ground adjacent to the wheel. Thus some mechanism is required to feed the material back to the buckets of the wheel. The present invention accomplishes this through operation of a first or second retractable crumbing blade means 17 or 18.

Figure 3:
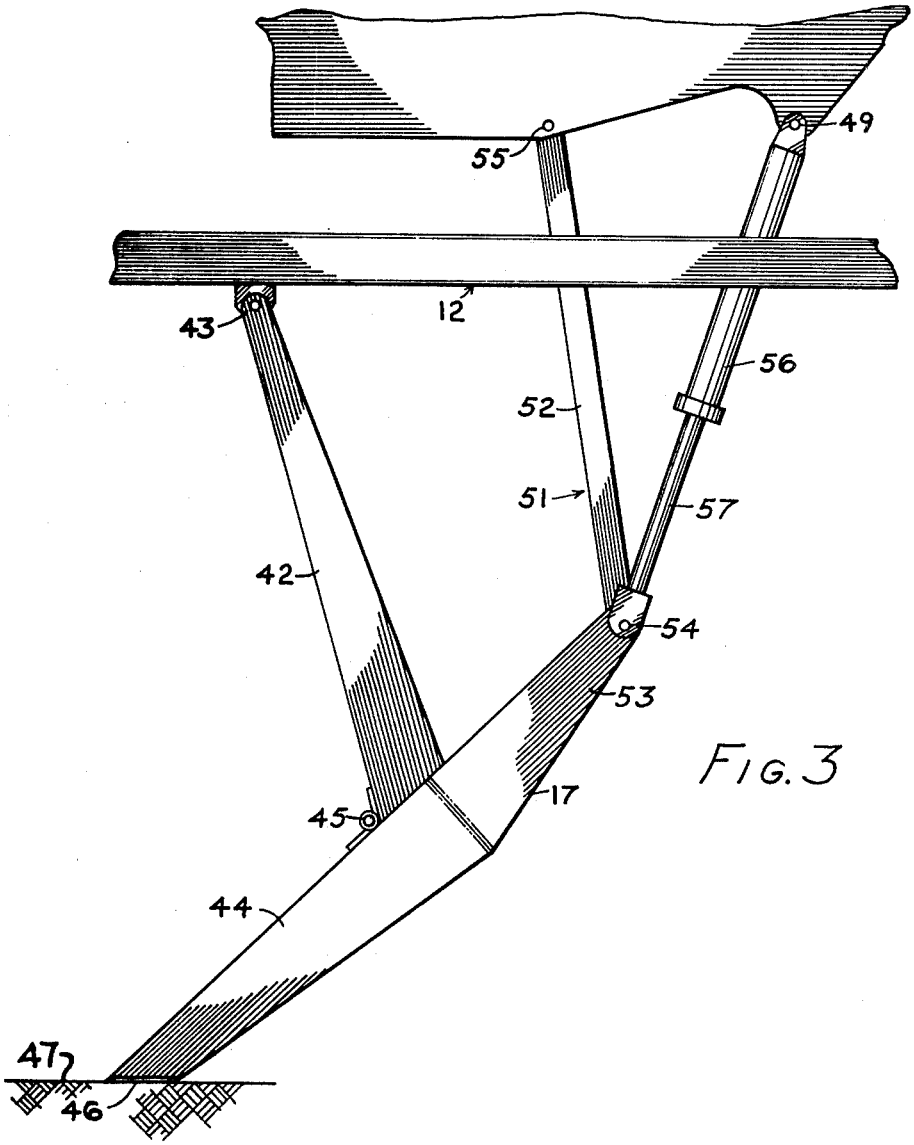
FIG. 3 is an enlarged fragmentary view of a single crumbing blade assembly of my invention.
Figure 4:
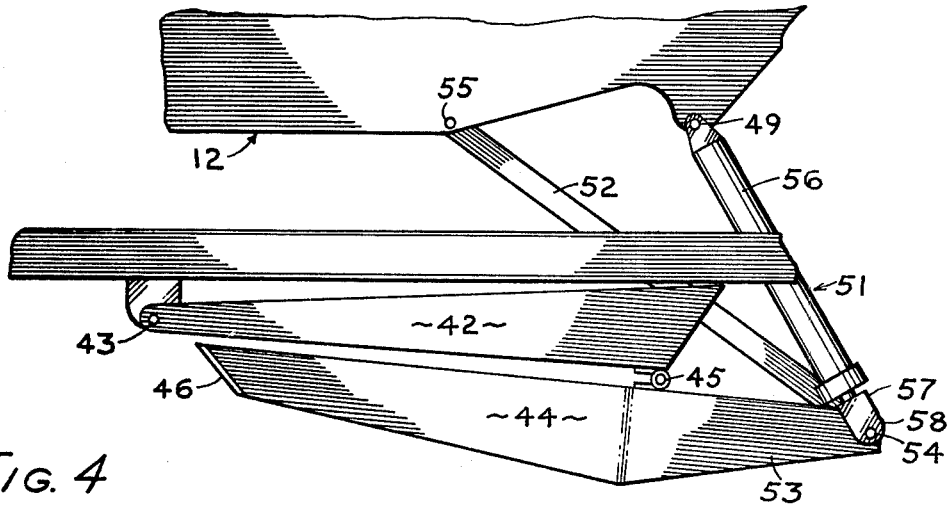
FIG. 4 is a view similar to FIG. 3 only showing the crumbing blade assembly in an inoperative position.

The crumbing blade means 17 and 18 constitute a very important provision of the present invention. The blades are best seen in FIGS. 1, 3, and 4. It is means 17 and 18 that enable reversible movement of the machine and equally efficient operation in either direction. First means 17 operates in a forward direction (arrow A in FIGS. 1 and 6) to refeed material to the wheel 14 and to strike an accurate grade level behind the machine. The second crumbing blade means 18 is operable to accomplish a similar function while the machine moves in a rearward direction (arrow B, FIGS. 1 and 7). As may be noted, both means 17 and 18 are selectively retractable. Thus, when one means is operative, as is means 17 as shown in FIG. 1, the remaining means 18 is held in an inoperative retractive position. A lift means 19 is employed to selectively move the crumbing blade means 17 and 18 between their respective operative and inoperative positions.

The above paragraphs were given as an overview as to the general construction and arrangement of elements of the present invention. The following paragraphs will contain a more detailed description of the invention and its mode of operation.

Figure 2:
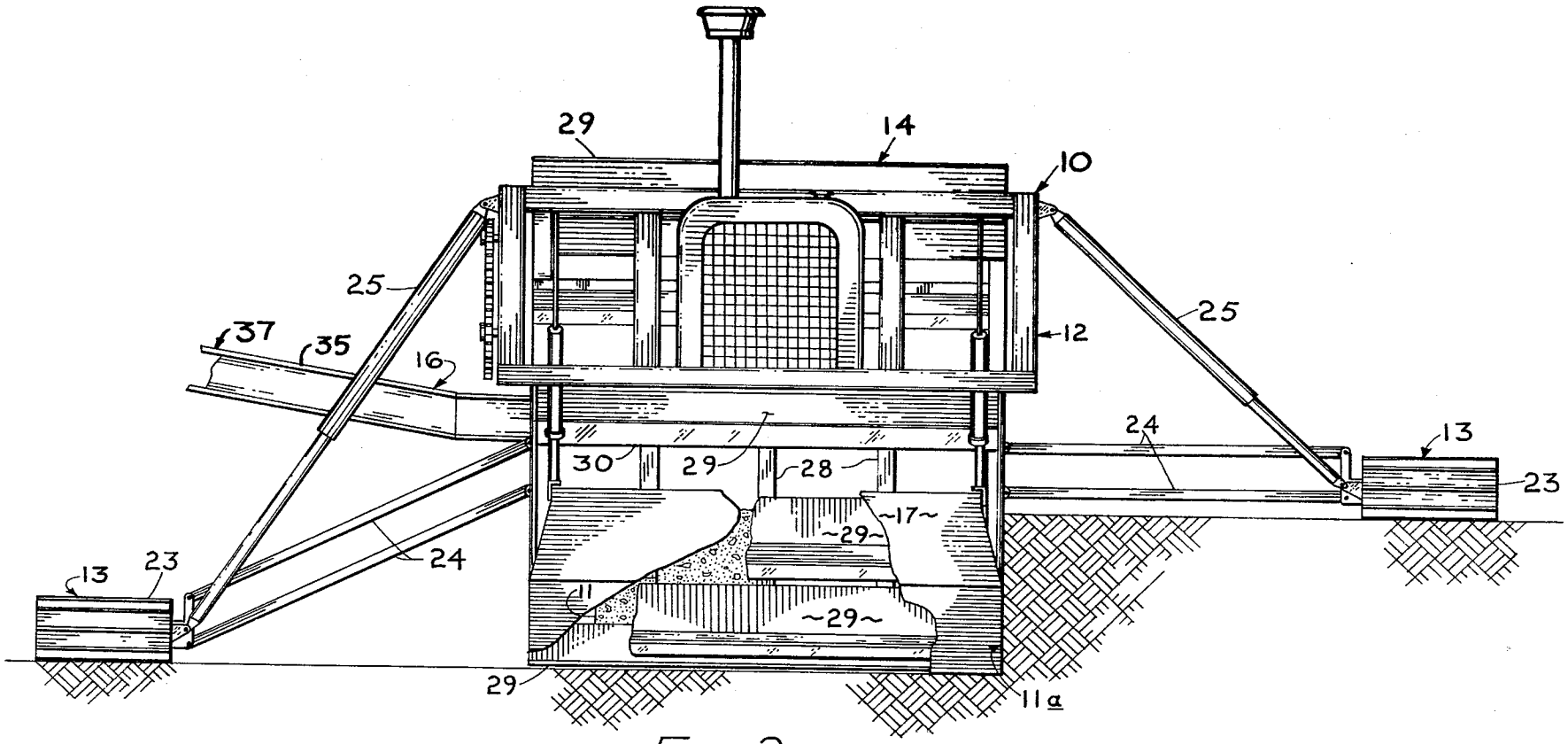
FIG. 2 is a partially fragmented rear elevation view.

Referring back to the frame means 12, and particularly to the transport means 13 and supporting frame 12, reference will be had in particular to FIG. 2. As shown, the frame 12 is rigid in nature and is movably supported by the transport means 13. Tracks 23 are utilized by transport means 13 to provide mobility to the otherwise rigid frame 12. The tracks are interconnected with the frame 12 by opposed parallelogram support arms 24. The parallelogram support arms 24 enable selective positioning of the tracks relative to the framework. Thus, one track may be located above the other as shown in FIG. 2 without affecting the horizontal relationship of framework 12. The framework and tracks are relatively adjusted through use of opposed elevating cylinders 25. Thus, the frame may be raised or lowered selectively, relative to the elevation of tracks 23.

The excavator wheel 14 is shown in some detail in FIGS. 1 and 2. The wheel includes a substantially cylindrical periphery 28. This peripheral surface 28 includes a plurality of buckets 29. The buckets 29 are angularly spaced about the periphery 28 and each extends the full width of the wheel. Each bucket 29 includes a forward grader blade 30 (FIG. 1) and an open inner side. Thus, material may be loosened by the grader blades 30 and carried within the confines of the buckets upwardly. But the material is free to fall from the buckets once they become elevated above the conveying means 16.

It may be noted in FIGS. 6 and 7 that the wheel 14 will operate efficiently when moved in either a forward or rearward direction while being rotated in a fixed direction (arrow C). In the forward direction, the bucket blades 30 cut through the material in an upward motion. In the rearward direction, the same blades 30 cut through the material in a downward motion. Either mode of operation functions effectively to disengage and lift material toward the conveying means 16.

The wheel 14 is designed to function at depths slightly less than the radius to its periphery. Thus, an 8 feet diameter wheel would effectively operate to excavate a swath less than 4 feet in depth. Actually, the size of the wheel 14 (both diameter and width) is determined by the requirements of the project. A wheel capable of taking a 4 feet deep by 12 feet long swath would conceivably be effective in "strip mining" operations.

It may be noted that the wheel means 14 is transverse to the path of movement of the excavator 10. It is held in this position by a plurality of rollers 33 at opposite ends thereof. No support is provided at the rotational axis of the wheel in order to allow access by the conveying means 16. The wheel is driven through an appropriate linkage 31 by an engine 32. Of course, the linkage 31 is necessarily located above the ground surface.

Figure 5:
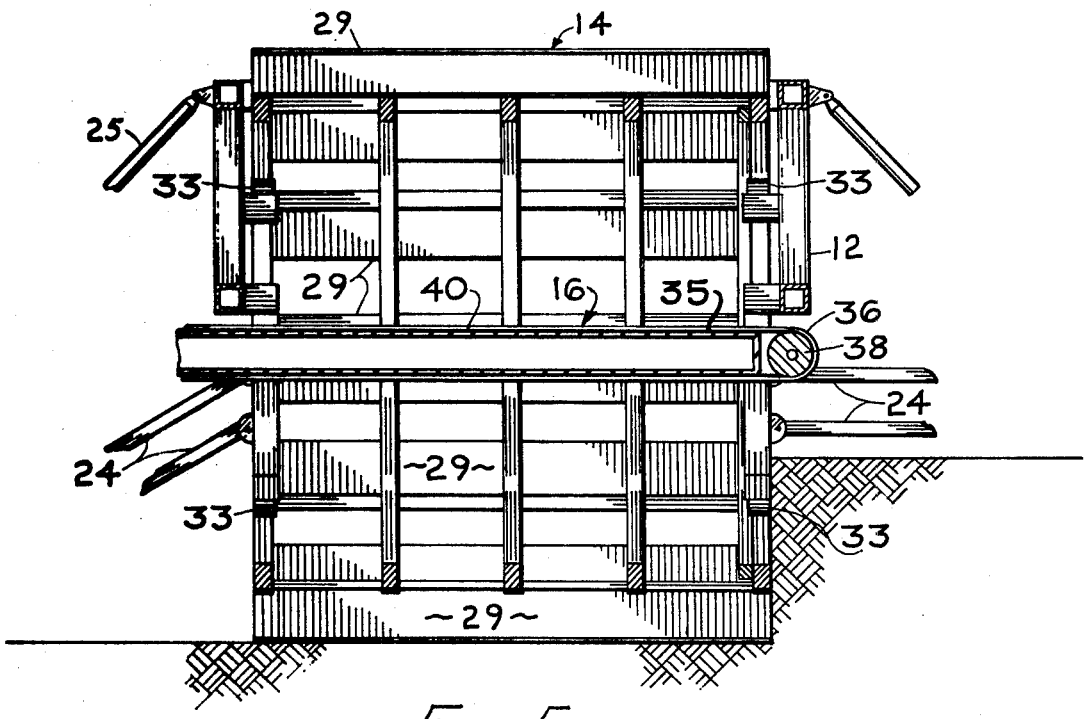
FIG. 5 is a cross-sectional view taken substantially along line 5—5 in FIG. 1.

The conveying means 16 is best illustrated in FIG. 5. It includes an elongated endless belt 35 that extends from an infeed end 36 to a discharge 37. Infeed end 36 is defined by an infeed roller 38. The working flight of belt 35 is indicated at 40. Flight 40 is to receive excavated material from the buckets 29 of wheel 14. The flight 40 extends within the confines of wheel 14 along its full transverse length and outward to a discharge (not shown) that is spaced laterally clear of the machine. A conventional drive (also not shown) is provided to continuously operate the belt to move about the course defined by the end rolls. Thus, material received from the buckets 29 is moved transversely through the length of wheel 14 and subsequently outward and off the discharge end. The material leaving the discharge end may be received by a secondary conveyor, dump truck, etc. so it may be removed for further processing or relocation.

The area of primary concern of the present invention is in the provision of the first and second retractable crumbing blade means 17 and 18. They are shown in substantial detail by FIGS. 1, 3 and 4. Since one blade means is the mirror image of the other, like reference numerals will be used to represent equivalent elements of both.

The blade means 17 and 18 each include a first blade section 42 that is mounted at a pivot 43 to the rigid framework 12. A second blade section 44 is movably mounted to the first section 42 by a hinge 45. A lower transverse edge of the second blade section 44 includes an elongated cutting edge or "shoe" 46. This shoe 46 defines the grade level of the finished excavation when located in the operative position (FIG. 3). When the associated blade is located in the fully lowered operative position, the shoe 46 is located in a plane that is substantially tangent to the bottom of wheel means 14. This plane is indicated in FIG. 3 by the reference character 47. Since the blade sections are relatively movable, the plane 47 may be selectively adjusted upwardly.

The blades 42 and 44 are connected to trapezoidal linkages 51. These linkages 51 and the relationship of the pivot axes for the associated blade sections enable folding movement of the blades between the operative position (FIG. 3) and the inoperative position (FIG. 4). Each linkage is comprised of a radius rod 52 interconnecting the frame 12 with an arm portion 53 of blade section 44. Rod 52 is pivoted at 54 on the arm part 53. A pivot 55 is provided at the opposite end of radius rod 52 on frame 12. Identical arm arrangements are provided at opposed ends of the blade means 17 and 18.

A double acting hydraulic cylinder 56 is connected at opposite ends of the means 17 and 18. Each cylinder 56 includes a piston 57. The piston 57 is mounted by a clevis 58 to the second blade section 44, at the pivot 54. The remaining end of the cylinder body is mounted at a pivot 49 to frame 12. Cylinders 56 are operated through selectively operated lock valves (not shown) that will prevent flow in either direction when a selected position of the associated crumbing blade means is obtained. Thus, when locked, the cylinder functions as a rigid structural member, transferring forces from the blades to the rigid frame 12.

From the above general and detailed description, operation of the present invention may be easily understood. Prior to starting an excavation, the machine is located at one end of the desired swath to be taken with the wheel perpendicular to the existing face. The drive means 15 is then actuated to operate the excavating wheel 14. While in operation, the elevating cylinders 25 may be operated to selectively adjust the depth of cut to be taken by the wheel. Once this is set, the excavator is put into motion, moving against the material to be excavated. As the machine moves slowly along, the rotating grader blades slice through the material and lift it upwardly to be dropped on to the working flight of conveying means 16. The material that remains on the conveying means is delivered outwardly to the discharge end thereof.

Excavated material is either passed from the wheel means 14 to the conveyor means 16, or is gathered and refed to the wheel means by one or the other of the crumbing plate means 17 or 18. When the machine is moving in a forward direction, it is the first crumbing blade means 17 that is held in the operative position while blade means 18 is retracted and inoperative. During operation, the blade means 17 is located closely adjacent to the periphery 28 of wheel means 14. This prevents excessive buildup of material between the blade means and wheel. Obviously, the amount of drag or resistance to movement in the forward direction is reduced substantially by holding the blade in close relation to wheel 14.

The operative blade means 17 functions to refeed material to the wheel means 14 while moving in the forward direction and also serves to precisely locate a grade level that is relatively smooth. The accumulated material forward of the blade serves to fill holes, or the shoe 46 will scrape elevated spots to leave a smooth flat surface behind the excavator.

After the excavator 10 has reached the end of the desired swath, it may be moved laterally inward of the face just formed to start the next successive swath. Blade means 17 is then retracted while blade means 18 is extended. Drive means 15 is then again actuated and the same process is repeated while the excavator moves rearwardly along the length of the next successive swath. Crumbing blade means 18 will here serve the same function as did blade means 17, the only difference being that the grader blades 30 cut through the material in a downward movement as opposed to the upward cutting motion when the machine is moved in a forward path.

The above description was given by way of example to set forth a preferred form of the present invention. However, it is understood that other uses and designs may be contemplated without departing from the scope of the invention. Therefore, the following claims are to be taken as definitions of and limitations upon the scope of the invention.

What I claim is:

1. A bidirectional excavating machine, comprising:

a rigid framework;

means carrying the framework for movement along a ground surface in a forward or rearward direction along a selected path;

an excavator wheel mounted to the framework for rotation about an axis transverse to said path;

drive means on said framework operatively connected to the excavator wheel for rotating it about said axis;

conveying means on said framework, said conveying means being located within the confines of the excavator wheel for receiving excavated material from the excavator wheel and for moving the material to one side of the machine;

said excavator wheel having a plurality of peripheral bucket members for engaging and lifting the material upward upon rotation of the wheel and for subsequently dropping the lifted material onto the conveyor means;

first crumbing blade means pivotally mounted to the framework at a location forwardly adjacent to said excavator wheel about axes parallel to the rotational axis of the excavator wheel;

first lift means operatively connected between the framework and said first crumbing blade means for moving said first crumbing blade means between a lowered operative position and a raised inoperative position;

second crumbing blade means pivotally mounted to the framework rearwardly adjacent to the excavator wheel about axes parallel to the rotational axis of the excavator wheel;

second lift means operatively connected between the framework and said second crumbing blade means for moving said second crumbing blade means between a lowered operative position and a raised inoperative position;

the lowered inoperative position of each of said crumbing blade means being directed angularly downward substantially tangential to the periphery of the excavator wheel;

the raised inoperative position of each of said crumbing blade means being substantially horizontal;

each crumbing blade means including an elongated crumbing shoe that, in the lower operative position, is located adjacent the horizontal plane tangential to the bottom portion of the excavator wheel and closely adjacent the peripheral surface thereof, and that, in the raised inoperative position, is elevationally raised a substantial distance above its operative position so as to provide clearance for the excavator wheel;

each of said lift means comprising spaced rigid links pivotally connected to both the framework and crumbing blade means about parallel axes, the effective lengths of the respective links differing from one another so as to impart an angular folding motion to said crumbing blade means as they are moved between their operative and inoperative positions.

* * * * *